US005590453A

United States Patent [19]

Gajewski

[11] Patent Number: 5,590,453

[45] Date of Patent: Jan. 7, 1997

[54] SYSTEM AND METHOD FOR ENSURING PROPER INSTALLATION OF BLIND RIVETS BY MEASURING THE LENGTH OF SPENT MANDRELS

[75] Inventor: Gerard H. Gajewski, Dover, N.H.

[73] Assignee: Davidson Textron Inc., Dover, N.H.

[21] Appl. No.: 510,177

[22] Filed: Aug. 2, 1995

[51] Int. Cl.[6] ..... B21J 15/10; B23Q 17/00

[52] U.S. Cl. ..... 29/407.05; 29/466; 29/525.06; 29/243.521; 29/703; 29/705; 29/720

[58] Field of Search ..... 29/702, 703, 705, 29/707, 714, 715, 720, 721, 812.5, 243.521, 243.523, 243.53, 407.01, 407.05, 466, 524.1, 525.06; 72/391.4, 391.6

[56] References Cited

U.S. PATENT DOCUMENTS 4,754,643 7/1988 Weeks, Jr. et al. ..... 29/812.5
4,901,431 2/1990 Gast ..... 29/707
5,035,353 7/1991 Smart et al. ..... 29/243.521
5,125,151 6/1992 Smart ..... 29/706
5,357,668 10/1994 Roberts ..... 29/715

*Primary Examiner*—David P. Bryant
*Attorney, Agent, or Firm*—Reising, Ethington, Barnard & Perry

[57] ABSTRACT

A rivet system (10) locks separate parts (12, 14) of an assembly (13) together on a support fixture (20) with clamping devices (28) and prevents release of the parts (12, 14) from the fixture (20) until a required number of rivets (51) have been placed. A rivet setting tool (50) provides insertion of the rivets (51) between the parts (12, 14), and disposes spent rivet mandrels (62) through a vacuum tube (58) to be sensed. A detector (72) detects the spent rivet mandrels (62) and provides a signal to a controller (100), which measures the length of the mandrel to determine proper crushing or installation of the rivet (51).

28 Claims, 4 Drawing Sheets

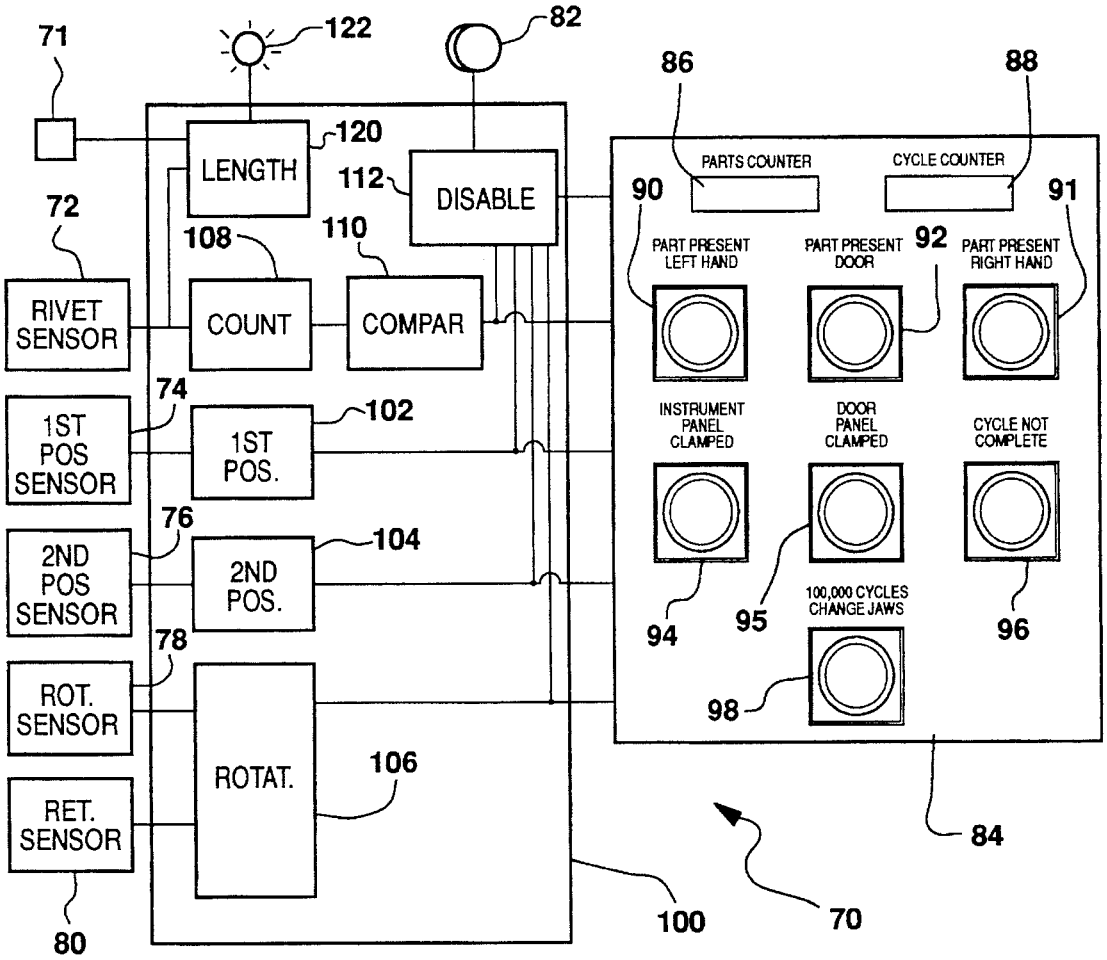
FIG - 3
FIG - 4
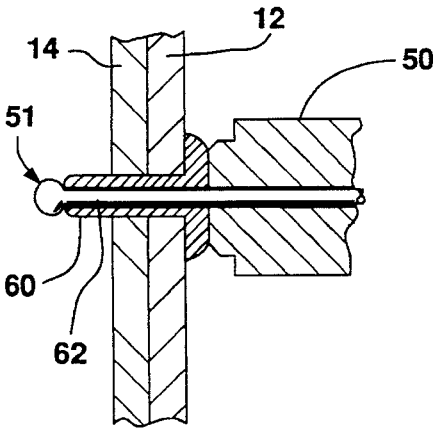
FIG - 5
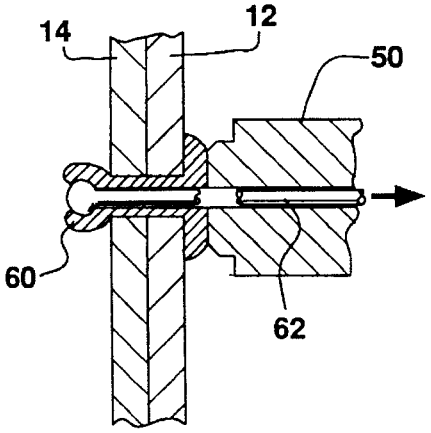

SYSTEM AND METHOD FOR ENSURING PROPER INSTALLATION OF BLIND RIVETS BY MEASURING THE LENGTH OF SPENT MANDRELS

TECHNICAL FIELD

The invention relates to riveting systems, and more particularly to riveting systems which detect spent rivets and determine proper placement or installation of such rivets.

BACKGROUND OF THE INVENTION

In the riveting of assemblies for connecting at least two parts together, it is common practice to provide visual inspection after the rivets have been applied by an operator with a hand-held, power-operated, rivet setting tool to assure that the predetermined number of rivets has been applied and such rivets have been properly installed. Such may be used on air bag door assemblies in an automotive instrument panel. Before the instrument panel with the air bag door assembly is allowed to be removed for subsequent assembly with the remainder of the air bag system in a vehicle, the operator visually ensures that the predetermined number of rivets have been properly installed. This is a significant time consuming and tedious task, and the operator can be distracted and err in carrying out such important assignment. There is limited ability to control the quality of such riveting process by an operator.

Where the rivets used are of the blind type having a break-away, rivet-setting mandrel, it has been proposed as disclosed in U.S. Pat. No. 5,125,151, issued Jun. 30, 1992 in the name of Smart, to count the number of rivets that are set in a work cycle on an assembly by sensing the spent mandrels with a proximity switch as they are carried away from the riveting tool by vacuum collection tube. When the mandrel count at the end of the work cycle is less than the prescribed number of rivets to be applied, a warning light is activated and the system is disabled from starting another work cycle until the required number of spent mandrels has been counted.

However, this patent does not preclude the possibility of a riveted assembly with less than the required number of rivets from being removed from the riveting workstation and sent on for its intended use, nor the improper installation or crushing of the rivets.

SUMMARY OF THE INVENTION

The subject invention specifically addresses the above-mentioned concerns in addition to providing other advantages with a rivet system wherein the rivets are counted and their length determined to ensure proper installation thereof. This is accomplished in a very cost effective manner by providing an assembly holding fixture at the workstation wherein the parts to be riveted are held together on the fixture for further riveting by one or more power operating clamping devices that are controlled by a controller. A detecting device is provided that produces a signal indicating each time a rivet is applied to the parts of the clamped assembly by a rivet setting tool and which indicates the length thereof. The controller is responsive to the rivet signal to verify proper installation of each rivet by determining the length of each spent rivet mandrel, and prevent release by the clamping devices of the parts until a prescribed number of signals has occurred.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is a schematic diagram of the controller and display panel;

FIG. 4 is a sectional view illustrating the insertion of a rivet in the air bag door assembly in FIG. 1;

FIG. 5 is a section view as in FIG. 4 illustrating break away of the spent mandrel.

DETAILED DESCRIPTION OF THE EMBODIMENT

Figure 1:
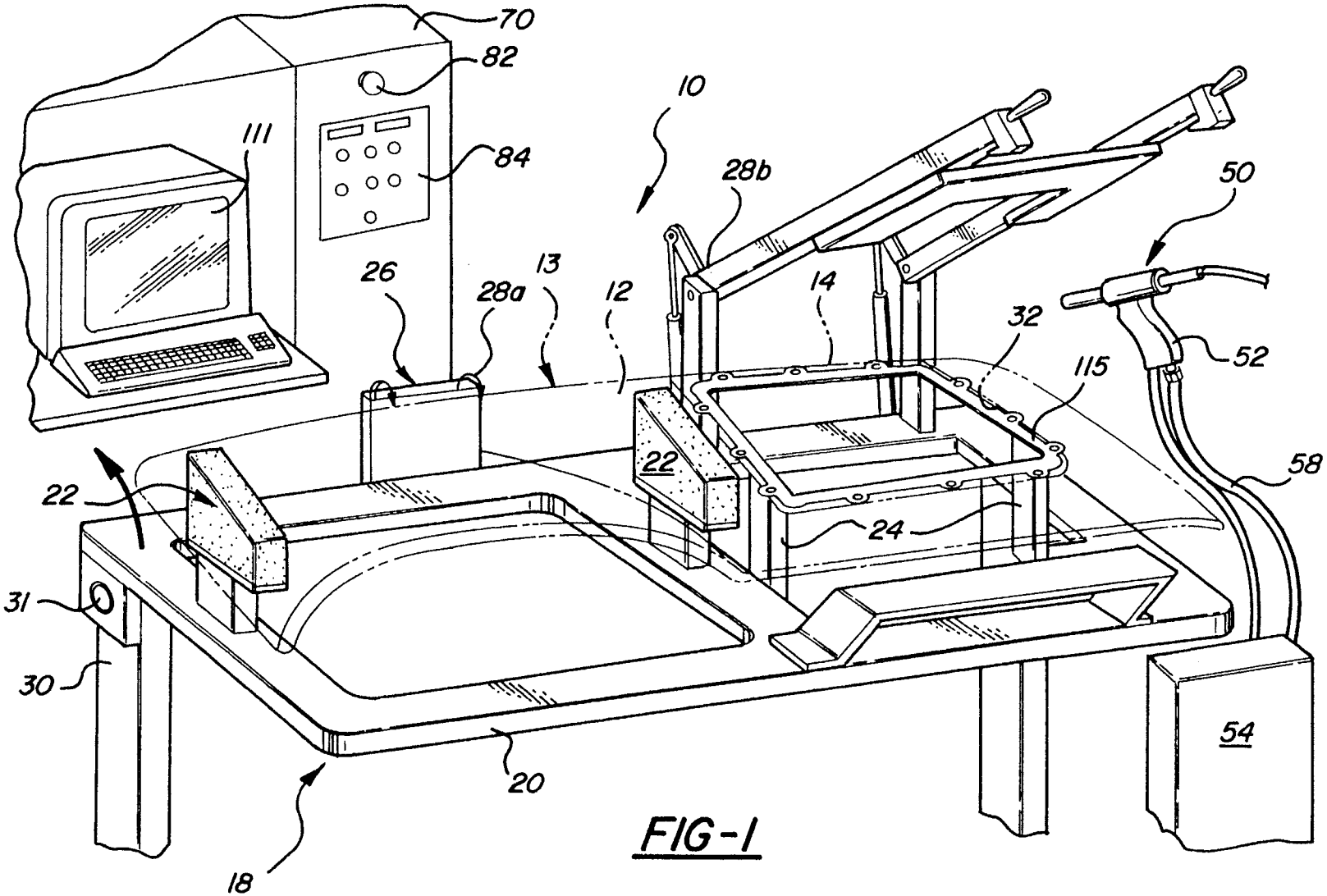
FIG. 1 is a perspective view of the riveting system as applied to an air bag door assembly in an automotive instrument panel.
Figure 2:
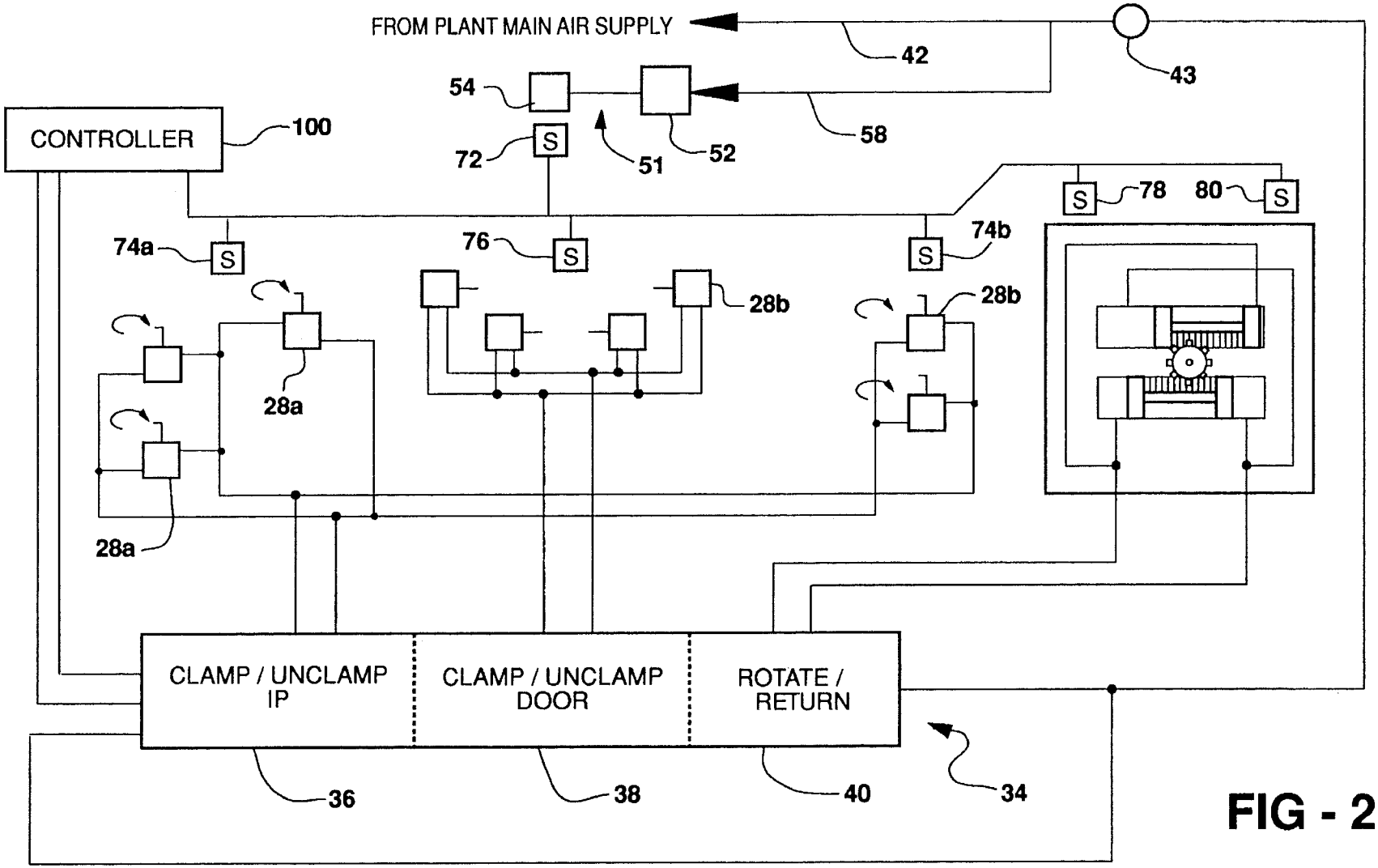
FIG. 2 is a diagrammatic view of the system controls of the riveting system of FIG. 1.

A riveting system 10 for riveting together of at least two members or parts 12, 14 with rivets 51 at a workstation 18 prior to removal of the so formed assembly 13 of connected parts 12, 14 from the workstation 18, is generally illustrated in FIG. 1.

The riveting system 10 includes a support fixture 20 connected to the workstation 18 for receiving and supporting the at least two parts 12, 14. The support fixture 20 allows the parts 12, 14 to be held and secured thereto during riveting of the parts 12, 14 to one another forming the assembly 13. In the preferred embodiment, the riveting system 10 is used to rivet an air bag door to an instrument panel 12. The first part 12 is equivalent to the instrument panel and the second part 14 is equivalent to the air bag door. However, other parts may be riveted together under the teachings of this invention, as can be clearly understood by one skilled in the art.

The support fixture 20 generally includes a first support portion 22 and a second support portion 24. The first support portion 22 supports the first member or instrument panel 12 in a predefined position with the second part or air bag door 14 being supported by the second support portion 24. In the illustrated embodiment, the instrument panel 22 includes an opening 32 therein sized to receive the air bag door 14 in the opening 32 for riveting in place. The support portions 22, 24 are generally comprised of support pads for placement of the parts 12, 14 in the predetermined positions.

The riveting system 10 also includes a locking apparatus 26 operatively connected to the support fixture 20 to hold and lock the two members 12, 14 together on to the support fixture 20. The locking assembly 26 includes a plurality of clamps 28 for locking each of the two members 12, 14 to the support fixture 20 adjacent and aligned with one another in the predefined positions. In the preferred embodiment, the clamps 28 are pneumatically controlled, as subsequently discussed. The clamps 28 include a plurality of panel clamp **28*a* (only a portion indicated in FIG. 1) which are positioned about the circumference of the instrument panel 12 to clamp the instrument panel 12 against the support fixture 20. The clamps 28 also include a plurality of door clamps 28*b* (only a portion indicated in FIG. 1) positioned adjacent the door 14 when positioned within the instrument panel 12 to clamp same thereagainst and to the fixture 20. It should be understood that manually actuated clamps may be used in addition hereto to aid the user in positioning the parts 12, 14**.

In the preferred embodiment, the support fixture 20 with the panel support portion 22 and door support portion 24 is rotatable with respect to the workstation 18 by a rotating apparatus 31, generally a rack and pinion gearing. The support fixture 20 is rotatably supported on a base support 30. In operation, the instrument panel 12 and door, 14 are placed on the rotatable fixture 20 with the finish side facing upward and the working side down for clamping in the unrotated or return position. Once clamped, the rotatable fixture 20 rotates approximately 180° to expose the working side or backside of the parts 12, 14 in a rotated position. It is the backside of the parts 12, 14 which are operated on and riveted for connection thereof.

The riveting system 10 includes an actuator assembly 34 for activating and deactivating the clamps 28 and rotation of the fixture 20. The actuator assembly 34 includes panel and door locking actuators 36, 38 and a rotating actuator 40. The actuator assembly 34 in the preferred embodiment is pneumatic based; however, other types of systems may be utilized as can be appreciated by those skilled in the art, such as electronic, hydraulic, etc. The locking actuators 36, 38 are connected to the clamps 28 for controlling clamping and unclamping in response to control signals, as subsequently discussed. The clamps 28*a* used to clamp the first part or panel 12 are roto-shaft clamp cylinders, preferably five in number. The clamps 28*b* used to clamp the second part or door 14 are linear clamp cylinders, preferably four in number.

The actuator assembly 34 is connected to a main air supply line 42 supplying approximately 95 psi through regulator 43.

The locking actuators 36, 38 are comprised of a series of pneumatic solenoids and valves for switching air pressure to the pneumatic clamps 28 to cause clamping and unclamping in response to control signals, to control the solenoids to selectively supply air controlling clamping and unclamping. Such pneumatic control systems are commonly known in the art.

The rotating actuator 40 generally comprises a rollover actuator, such as available by phd inc., to pneumatically control rotation and return of the fixture 20. The rotating actuator 40 controls the rack and pinion drive gearing 31 which is directly connected to the fixture 20.

The riveting system 10 also includes a rivet setting tool 50 operable to apply rivets 51 to the at least two members 12, 14 to connect the members 12, 14 to one another forming the assembly 13. The rivet setting tool 50 may be as those commonly known in the art, such as the ATG Multihead Remote System by Avdel Corporation. The rivet setting tool 50 includes a hand-held placing head 52 and remote vacuum collection unit 54 to remove spent rivet mandrels 62 from the placing head 52 by transferring the spent mandrels 62 through a vacuum tube 58 to the collection unit 54.

As known in such a rivet setting tool 50, the rivets 51 are set with the placing head 52, as illustrated in FIG. 3. The unused or unspent rivets 51 comprise a partially formed hollow rivet body 60 and a mandrel 62 comprising a rivet head at the partially formed insertion end of the rivet body 60 and a stem that extends through the rivet body 60 and which is grasped and held by the setting tool 50. The mandrel 62 is forced through the hollow rivet body 60 upon insertion into the parts 12, 14. The stem of the mandrel 62 is broken and disposed through the vacuum tube 58, e.g., the spent rivet mandrel, as illustrated in FIG. 5.

The rivet system 10 also includes a system control apparatus 70 operatively connected to the locking assembly 26 and the rivet setting tool 34 to prevent release of the members 12, 14 and assembly 13 until determining that a predetermined number of rivets 51 have been set.

The system control apparatus 70 includes a rivet sensor 72 connected to the rivet setting tool 50 for detecting the spent mandrel and for producing a rivet signal upon detection of each of the spent rivet mandrels. In the preferred embodiment, the vacuum tube 58 includes a clear glass tube portion and the rivet sensor 72 is connected thereat to detect the spent rivet mandrels passing therethrough. The rivet sensor 72 may be of any type including proximity, infrared, optical, etc., and preferably comprises a laser switch sensor. The rivet sensor 72 comprising the laser produces a laser beam across the clear tube and onto a light sensitive switch. When the spent rivet mandrel 62 breaks the laser beam, the amount of time that the beam is broken is sent in the rivet signal, i.e., pulse duration.

The system control apparatus 70 determines the length of each spent rivet mandrel 62 and counts the number of mandrels 62 detected in the vacuum tube 58 by the rivet signal from the rivet sensor 72. Release of the locking apparatus 26 occurs upon obtaining a predetermined count. In the preferred embodiment, fifteen rivets 51 are placed or set in the assembly 13 to secure the two parts 12, 14 together comprising the predetermined count. However, it is to be understood that any other count may be selected as required by the parts being connected.

The system control apparatus 70 includes a pair of first part sensors 74 for determining the proper placement and presence of the instrument panel or first part 12. The first sensors 74 are spaced to detect opposite ends of the first part 12, i.e., right and left side. A second part sensor 76 detects the presence and proper placement of the door or second part 14. Each of the sensors 74, 76 produces an electronic signal indicating whether the part 12, 14 is present or not. Such sensors 74, 76 may be any type to indicate whether or not the parts are properly located on the fixture 20, such as contact sensors, proximity, optical, etc. In the preferred embodiment, such sensors 74, 76 include proximity sensors, commonly available from phd inc.

There is also included a rotate sensor 78 and a return sensor 80 for indicating complete rotation or return, respectively, of the support fixture 20 between the rotated position and the return position. Each of the sensors 78, 80 may be proximity sensors, or any other position sensors as commonly known in the art. In the preferred embodiment, the sensors 78, 80 are also proximity sensors. The sensors 78, 80 produce a control signal upon actuation or detection thereof.

A control switch 82 is connected to the workstation 18 to allow automatic operation by the operator to cause clamping and rotation of the parts 12, 14 for riveting thereof, and return upon completion of the riveting.

The system control apparatus 70 includes a status panel 84 for indicating various statuses of the system control apparatus 70. The status panel 84 includes a plurality of indicators comprising lights and numeric counters. A parts counter 86 indicates the number of rivets counted from the rivet setting tool 50 for a particular assembly 13. The cycle counter 88 indicates the number of assemblies 13 formed. Two of the indicators 90, 91 are responsive to the first part sensors 74 and indicate whether the first part 12 is present (right 91 and left 90 sides, separately). A third indicator 92 is responsive for the second part sensor 76 and indicates whether the second part or door 14 is present. Another pair of clamp indicators 94, 95 indicate when the instrument panel 12 is clamped and the door 14 is clamped, respectively, and therefore being rotated (clamped) and unrotated (unclamped). An alarm indicator 96 indicates that the cycle is not complete, i.e., when there are not exactly the predetermined number of rivets counted and the support fixture 20 is attempted to be rotated. A cycle indicator 98 indicates when a predetermined number of cycles is reached to require service on the support fixture 20. The indicators 90, 91, 92, 94, 95, 96 are generally comprised of lights to indicate the status thereof. The counters 86, 88 are generally comprised of digital electronic counters.

The system control apparatus 70 includes a controller 100 for receiving the signals from the sensors 72, 74, 76, 78, 80 and for controlling the fixture 20 movement and clamping and status panel 84. The controller 100 provides the control signals to the actuator assembly 34 in response to the sensor signals and control switch 82, according to the flowchart illustrated in FIG. 6.

The controller 100 includes a length processor 120 for receiving the rivet signal to calculate the length, and an additional error length indicator 122 may be included to alarm the user if the calculated length was not "proper". The length of the spent mandrel is calculated based on the force of vacuum or speed of vacuum pump, and the time the laser in interrupted, and resistance of the mandrel.

The steps to determine the length of the spent mandrel are:

a) calculate the speed of the mandrel by monitoring vacuum pressure;

b) measure time of laser interrupt; and c) calculate length of mandrel.

The speed of the mandrel may be calculated from known equations. A vacuum sensor 71 monitors the vacuum pressure and is positioned in the vacuum tube 58. Thereafter, the laser interrupt time is easily determined from the rivet signal for calculation of the length, as could be understood by one skilled in the art. For example, either a standard vacuum value may be used or a variable value by vacuum pressure 71. A mercury reading may be obtained which can easily be translated to feet/second. With the measured time from the laser, the length may be calculated.

The length of the spent mandrel is compared to a predetermined range, i.e., 50 mm±1 mm. However, various sized rivets may be used which will vary the predetermined range. If the length is outside of the predetermined range, an alarm may be actuated by indicator 122. The user must thereafter reapply a rivet, or scrap the assembly.

The controller 100 includes first position means 102 for receiving the sensor signals from the pair of first part sensors 74 to control the respective indicator lights 90, 91. When the instrument panel or first part 12 is properly positioned on the fixture 20, the sensors 74 transmits a signal, and the first position means 102 sends an actuate signal to the respective indicator light 90, 91. Second position means 104 is connected to the second part or door sensor 76 and is also connected to the door indicator 92 to indicate the presence and proper positioning of the door 14.

The rotate sensor 78 and return sensor 80 are connected to rotating means 106 for determining full rotation of the fixture 20 and full return of the fixture 20, and is also connected to the respective indicators 94, 95 to control indication thereof.

The controller 100 includes counting means 108 for counting the number of spent rivets detected by the rivet sensor 72 to provide indication of a current count. The counting means 108 receives the rivet signal and increments its count upon each rivet mandrel being detected. The controller 100 includes comparing means 110 for storing a predetermined count number, and upon actuation of the main control switch 82, comparing the stored number with the current count in the counting means 108, and initiating rotation to the returned position only when there is a predetermined relationship, i.e., equal.

The controller 100 includes disable means 112 for receiving disable signals from each of the position means 102, 104 and rotating means 106 and comparator 110 to prevent rotation if the parts 12, 14 are not properly installed, and to prevent return after rotation when the predetermined count has not been reached. The control switch 82 acts as a toggle switch between rotate and return positions.

The controller 100 is generally implemented by a programmable logic controller, and alternatively maybe so implemented any other type of computing or electronic system is commonly known in the art. A common computer 111 may be utilized in conjunction with the controller 100 to set the predetermined count number and any other information, or in place thereof.

Figure 6:
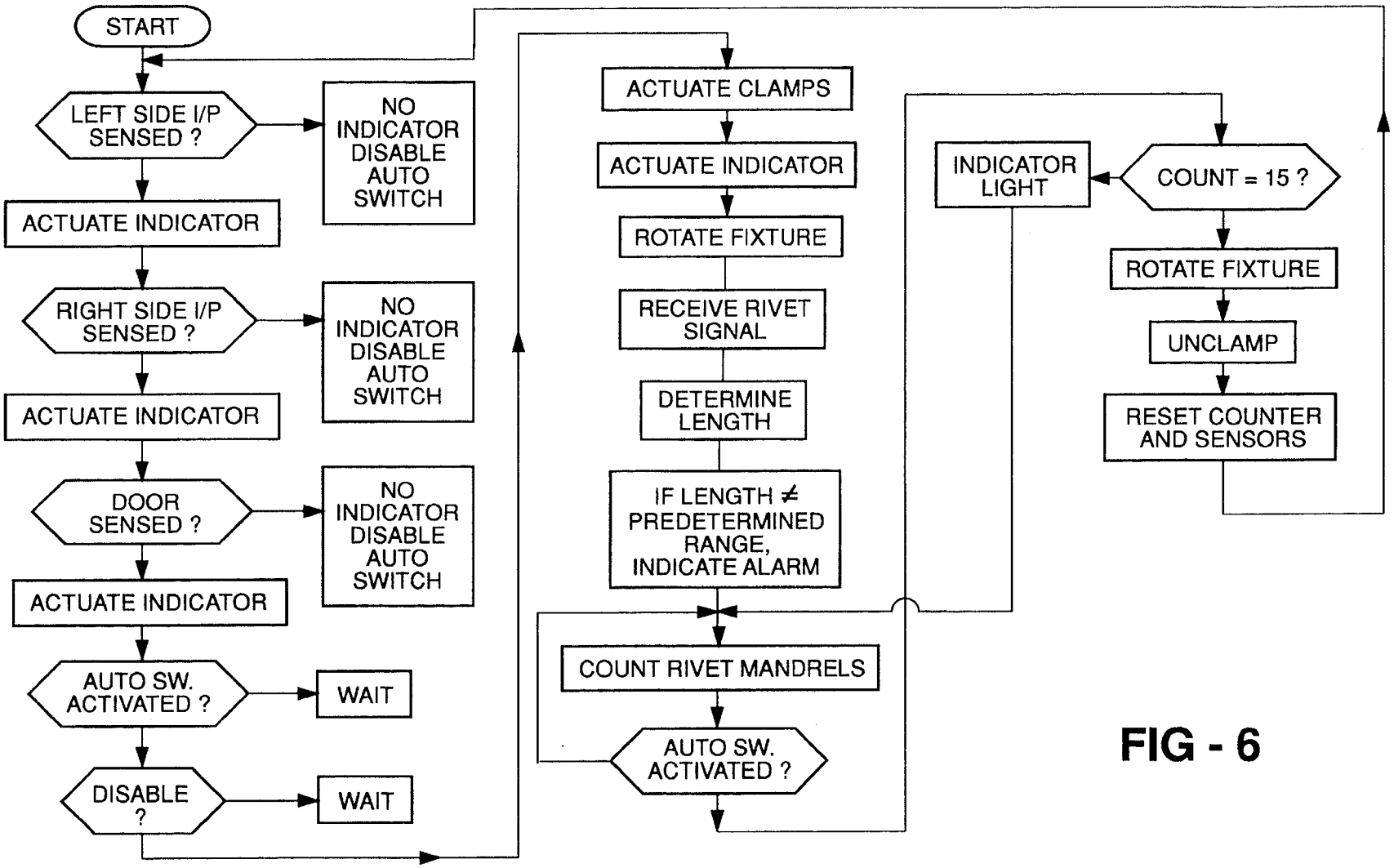
FIG. 6 is a flowchart of the controller of the subject invention.

The controller 100 operates under the flowchart illustrated in FIG. 6. In general, a frame 115 is initially placed on the support fixture 20, and thereafter the instrument panel 12 is positioned appropriately thereon. The controller 100 awaits detection of the left side of the instrument panel 12 and of the right side of the instrument panel 12. Upon proper placement and detection thereof, the first position means 102 actuates the respective indicator lights 90, 91 upon separate detection of the right and left sides. When the instrument panel 12 is not detected, no indicator 90, 91 is lit and a disable signal is produced. Thereafter, the door 14 is placed over the instrument panel 12 at the appropriate position, namely in the opening 32 provided by the instrument panel 12 and aligned with the frame 115. When the door sensor 76 detects the presence of the door 14, a signal is sent to the second position means 104 of the controller 100 which then provides indication thereof through the door indicator 92. Otherwise, a disable signal is produced.

Thereafter, the controller 100 waits actuation of the control switch 82. Upon actuation thereof, it is determined whether a disabled signal is received from one of the prior part sensors 74, 76. If a disable signal is received, no action occurs. Otherwise, the controller 100 automatically actuates the clamps 28 and provides indication thereof by the clamp indicator 94. 95. Thereafter, the fixture is rotated to its full rotated position as detected and verified by the rotate sensor 78. Thereafter, the operator may insert the required number of rivets, i.e., 15. Each spent mandrel is detected by the mandrel sensor 44 and provided to the controller 100. Upon each rivet signal being received, the controller 100 determines the length of the mandrel and compares same to a preset range. If out of the range, the alarm 122 is actuated to indicate improper rivet installation. At any time the control switch 82 is actuated when less than 15 mandrels are counted, the alarm indicator 96 will light and the assembly 13 will not be rotated. Only when the proper count is reached and thereafter the control switch 82 has been activated will the fixture be rotated. Upon rotation, the clamps are automatically released and the sensors and mandrel counter reset.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein the invention may be practiced otherwise than as specifically described.

What is claimed is:

1. A riveting system for ensuring the riveting together of first and second parts with rivets at a workstation, said rivets each including a body portion and a pulling mandrel, said system comprising:

a support fixture located at the workstation for receiving the parts;

a rivet setting tool operable to apply rivets to said parts to connect the parts to one another to form an assembly, said rivet setting tool including a disposal tube for receiving spent rivet mandrels; and a system control apparatus connected to said rivet setting tool for detecting the spent rivet mandrels and for determining the length of each spent rivet mandrel.

2. A system as set forth in claim 1 wherein said support fixture comprises a first support portion for supporting the first part and a second support portion for supporting the second part in predetermined positions.

3. A system as set forth in claim 1 wherein said system control apparatus includes a rivet sensor for detecting the spent rivet mandrels and for producing a rivet signal representative thereof.

4. A system as set forth in claim 3 wherein said system control apparatus includes a controller for receiving said rivet signal and for determining the length of each spent rivet mandrel.

5. A system as set forth in claim 4 wherein said disposal tube comprises a vacuum tube for receiving a spent rivet mandrel after application of each rivet said rivet, sensor being connected thereto to detect each spent rivet mandrel.

6. A system as set forth in claim 5 wherein said system control apparatus includes an alarm indicator, said controller including length means for comparing the length of each spent rivet mandrel to a preset range and actuating said alarm indicator when the length does not have a predetermined relationship to said preset range.

7. A system as set forth in claim 6 wherein said system control apparatus includes a counter for receiving said rivet signal and providing a complete indication when a predetermined number of spent rivet mandrels have been detected.

8. A system as set forth in claim 7 further including a locking device operatively connected to said support fixture to hold and lock the parts together on said support fixture.

9. A system as set forth in claim 8 wherein said controller includes clamp means for releasing said locking device upon detecting said predetermined number of spent mandrels.

10. A system as set forth in claim 8 further including an actuator assembly for activating and deactivating the locking device for rotating said support fixture between a rotated and returned position to allow riveting of the parts in the rotated position with the locking device locking the parts to the support fixture.

11. A system as set forth in claim 10 wherein said actuator assembly comprises first and second part actuators for controlling clamping and unclamping of said locking device in response to separate control signals for each part.

12. A system as set forth in claim 11 wherein said actuator assembly includes a rotating actuator for controlling rotation of said support fixture with respect to the workstation in response to a control signal and for controlling return of said support fixture to a return position.

13. A system as set forth in claim 12 wherein said actuator assembly is pneumatically controlled.

14. A system as set forth in claim 13 wherein said system control apparatus includes a pair of first part sensors for determining the proper placement and presence of the first part on said support fixture and for producing a signal upon detection thereof.

15. A system as set forth in claim 14 wherein said system control apparatus includes a second part sensor for detecting the presence and proper placement of the second part on said support fixture and for producing a signal indicative thereof.

16. A system as set forth in claim 15 wherein said system control apparatus includes a rotate sensor for indicating complete rotation of said support fixture and a return sensor indicating return of said support fixture to said return position and for producing control signals indicative of the detections thereof.

17. A system as set forth in claim 16 wherein said system control apparatus includes a status panel for indicating statuses of said system control apparatus.

18. A system as set forth in claim 17 wherein said controller of said system control apparatus receives the control signals from said sensors and controls the support fixture and status panel and locking device in response thereto.

19. A system as set forth in claim 18 wherein said controller includes first position means for receiving said sensor signals from said pair of first part sensors and for visually indicating proper positioning of said first part on said support fixture.

20. A system as set forth in claim 19 wherein said controller includes second position means connected to said second part sensor for visually indicating the proper positioning of said second part on said support fixture.

21. A system as set forth in claim 20 further including rotating means connected to said rotate sensor and said return sensor for visually indicating full rotation and full return of said support fixture.

22. A system as set forth in claim 21 wherein said counter counts the number of spent rivet mandrels which pass through said vacuum tube.

23. A system as set forth in claim 22 further including comparing means for storing said predetermined number and for comparing said predetermined number to the number of spent rivet mandrels counted by said counter to determine when said rivet sensor has detected said predetermined number and for visually indicating same.

24. A method of ensuring the riveting together of first and second parts with rivets at a workstation, said rivets each including a body portion and a pulling mandrel, the method including the steps of:

positioning said first part and said second part on a support fixture at the workstation;

holding said first and second parts together on the support fixture;

applying said rivets to the two parts to connect the two parts to one another to form an assembly, and disposing the spent rivet mandrels;

detecting the spent rivet mandrels; and automatically determining the length of each spent rivet mandrel to verify proper installment of the rivets.

25. A method as set forth in claim 24 further including comparing the length with a preset range.

26. A method as set forth in claim 25 further including indicating when the length is outside of the present range.

27. A method as set forth in claim 26 further including counting the spent rivet mandrels.

28. A method as set forth in claim 27 further including locking the first and second parts, and comparing the counted number of spent rivet mandrels to a predetermined number to allow release of the locked parts upon a predetermined relationship therebetween.

* * * * *